United States Patent [19]

Sternling

[11] Patent Number: 4,775,314

[45] Date of Patent: Oct. 4, 1988

[54] COAL GASIFICATION BURNER

[75] Inventor: Charles V. Sternling, Houston, Tex.

[73] Assignee: Shell Oil Company, Houston, Tex.

[21] Appl. No.: 4,288

[22] Filed: Jan. 6, 1987

Related U.S. Application Data

[63] Continuation of Ser. No. 736,166, May 20, 1985, abandoned, which is a continuation-in-part of Ser. No. 510,103, Jun. 30, 1983, abandoned.

[51] Int. Cl.[4] ..... F23J 7/00

[52] U.S. Cl. ..... 431/4; 431/354; 110/347; 239/145; 239/422; 48/197 R

[58] Field of Search ..... 431/4, 8, 187, 354; 239/145, 422, 424; 48/61, 95, 189.1, 215, 197 R; 110/261, 262, 263, 347, 348

[56] References Cited

U.S. PATENT DOCUMENTS

| | | | |
|---|---|---|---|
| 3,239,205 | 3/1966 | Metz | 239/145 X |
| 3,490,755 | 1/1970 | Lutgen | 239/145 X |
| 3,503,557 | 3/1970 | Hutton | 239/145 X |
| 3,857,910 | 12/1974 | Day | 239/145 X |
| 4,338,099 | 7/1982 | Crouch et al. | 239/427.5 |
| 4,408,984 | 10/1983 | Förster | 431/354 |

*Primary Examiner*—Margaret A. Focarino

[57] ABSTRACT

A transpiration-protected burner for coal gasification in which a gas such as steam, product synthesis gas or nitrogen is introduced through a porous wall immediately surrounding the openings through which coal and oxygen are introduced.

9 Claims, 1 Drawing Sheet

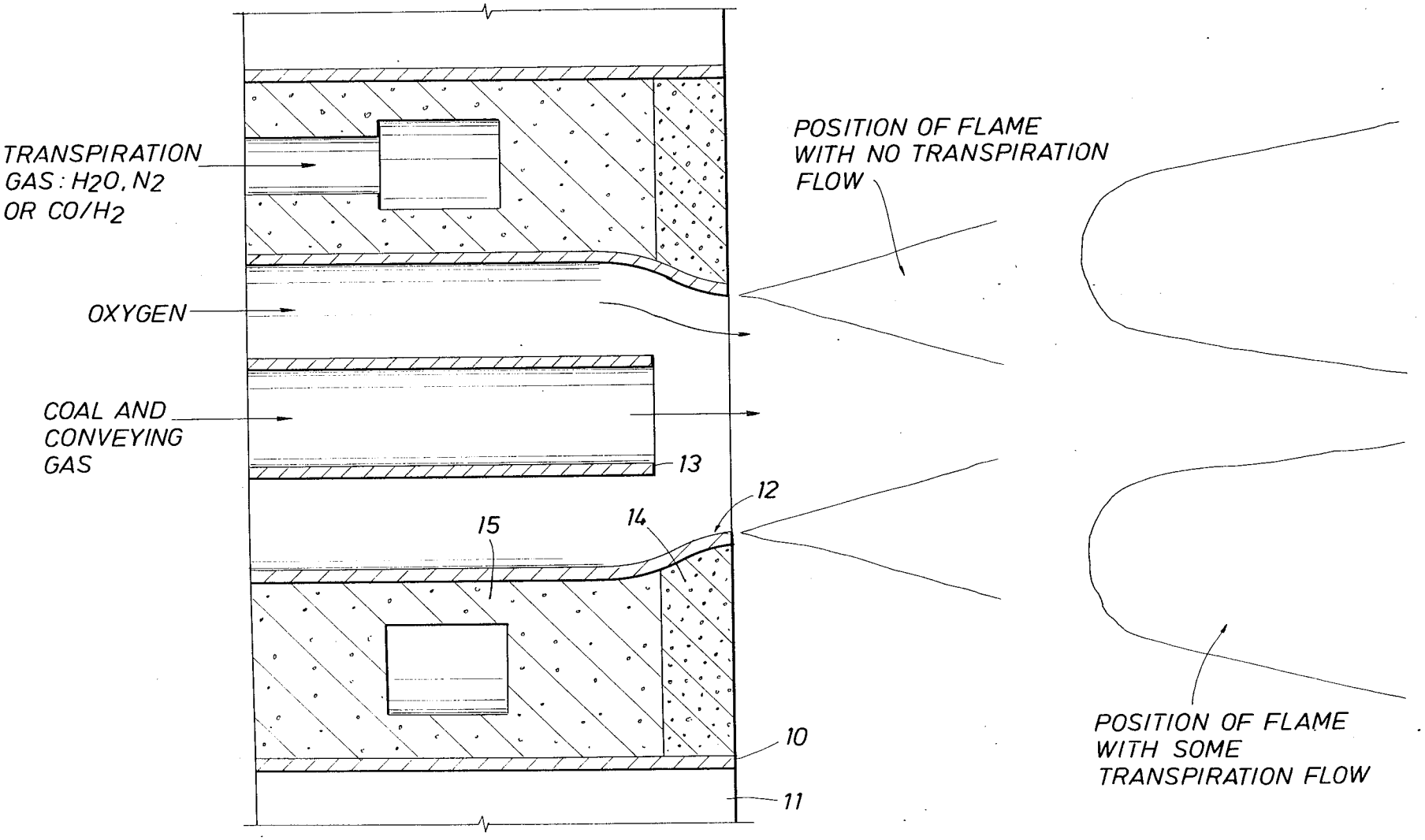
POSITION OF FLAME WITH NO TRANSPIRATION FLOW
POSITION OF FLAME WITH SOME TRANSPIRATION FLOW
10
11
12
13
14
15
TRANSPIRATION GAS: $H_2O$, $N_2$ OR $CO/H_2$
OXYGEN
COAL AND CONVEYING GAS

COAL GASIFICATION BURNER

REFERENCE TO RELATED APPLICATION

This is a continuation of application Ser. No. 736,166, filed May 20, 1985, and now abandoned, which is a continuation-in-part of application Ser. No. 510,103, filed June 30, 1983, now abandoned.

BACKGROUND OF THE INVENTION

The present invention relates to a burner for use in a partial oxidation process and particularly a burner for use in manufacturing synthetic gas from coal. The generation of synthetic gas is achieved by the partial oxidation of a hydrocarbon fuel with a free oxygen-containing gas at relatively high temperatures. The burner in a synthetic gas production facility must effectively mix the reactants while at the same time be protected from overheating or chemical attack from the reactants. Inadequate mixing of the reactants will produce a gas having a varying constituency, i.e. some localized areas will be oxygen-rich while other areas will have almost complete combustion. The burner may have a severely limited service life not only because of damage by high rates of heat transfer and, possibly also because of slag impingement on the surfaces exposed to the hot, high pressure, reactive gases inside the gasification reactor.

Various burners have been designed in an attempt to provide a structure which will provide complete mixing of the reactants while at the same time protecting the burner from both the high temperature of the reactants and chemical attack. In U.S. Pat. No. 3,847,564 there is shown a burner having three concentric nozzles with the tip of the central nozzle being recessed from the downstream or discharge end of the concentric nozzle. The center nozzle conveys hydrocarbon material while concentric nozzles supply oxygen-rich gas for partial combustion. The first two nozzles are surrounded by a third nozzle which supplies a stream of temperature moderating gas or steam. The discharge ends of the two concentric nozzles are designed with converging surfaces so that the two concentric streams mix with the hydrocarbon material adjacent the discharge end of the nozzle. As a result of the recessing of the cental nozzle, combustion occurs close to the wall of the combustion chamber, and the burner tip is subjected to high temperatures.

The present invention, in response to the above noted problems in the prior art, provides a new type of burner which avoids problems with subjecting the burner tip to high temperatures. This and other advantages of the present invention will be apparent from the following disclosure thereof.

SUMMARY OF THE INVENTION

The present invention provides a burner for use in a coal gasification process wherein there is a central passage for conveying oxygen to a combustion zone; a passage positioned coaxially within said central passage for passing hydrocarbon (e.g. coal) and conveying gas to the combustion zone; an exterior annular passage positioned coaxially outside said central passage for passing a transpiration gas to the combustion zone; and a porous wall separating the exterior annular passage and the central passage. Preferably, the part of the porous wall closest to the combustion zone is of low porosity and the part of the porous wall away from the combustion zone is of high porosity. In addition, the present invention pertains to a process for burning hydrocarbon (e.g. coal) in a gasification process including introducing combustion oxygen into a combustion chamber as a central gas flow; surrounding said combustion oxygen with a transpiration gas; and passing at least part of the transpiration gas through a porous wall surrounding the combustion oxygen. Preferably, the coal is introduced with conveying gas through a passageway inside the stream of combustion oxygen and the transpiration gas is one or a mixture of water, nitrogen, carbon monoxide and hydrogen.

BRIEF DESCRIPTION OF THE DRAWING

FIG. 1 provides a view of the burner constructed in accordance with the present invention.

DESCRIPTION OF PREFERRED EMBODIMENTS

The present invention provides a new type of burner wherein a gas such as steam, product synthesis gas, nitrogen, or the like, is introduced through a porous wall immediately surrounding openings through which hydrocarbon (e.g. coal) and oxygen are introduced. This arrangement has several advantages and purposes. First, liquid and solid particles or streams of slag coming from the ash in the coal are prevented from depositing as hard slag concretions close to the injection ports for hydrocarbon and oxygen. Such deposits, if formed, can deflect the flame jets, causing burner damage. Second, the surface of the burner is cooled by conductive heat transfer to the transpiration gas. Third, the flame resulting from mixing of oxygen with the hot combustible gases in the reactor is displaced away from the face of the burner further into the interior of the reactor. Fourth, unreacted oxygen is prevented from coming into contact with the face of the burner.

Referring now to the drawing, there is shown a burner constructed according to this invention installed in the wall 11 of a combustion chamber of a gasification reactor. The burner includes concentric tubes 10, 12 and 13. Preferably, tube 12 is constricted at its opening and extends slightly forward of tube 13. An oxygen stream is supplied through a central conduit outside tube 13 and inside tube 12, which may include steam, at a rate that is sufficient to properly disperse the coal particles which are inside tube 13. Normally, this rate will be in the range of 0.8 to 1.2 lbs. oxygen per lb. coal. A transpiration gas or gas mixture is supplied outside tube 12 and inside tube 10 and may include one or a mixture of water vapor, nitrogen, carbon monoxide and hydrogen. The purpose of the transpiration gas is to maintain the surface of the burner cool. To this end, conduit inside tube 10 and surrounding tube 12 is of a porous metal and preferably, that part of the conduit closest to the combustion zone, non-constricted part 14, is of a lower porosity metal. More preferably, constricted part 15 which is away from the combustion zone is of a porous metal of higher porosity. A suitable metal for this use is "INCONEL 718". Porous metals are made by processes well known in the art, e.g. a powdered metal is pressed together and then heated up to a high temperature. The extent to which the powdered metal is compressed is a factor in determining its degree of porosity. In the present invention it is critically important that part 14 be non-constricted and be of lower porosity metal. This ensures a better distribution of flow and reduces chances of plugging the burner. A tendency to channeling of flow in higher porosity part 15 is offset by a tendency to dispersion of flow in lower porosity part 14.

The hydrocarbon, for example, coal, which is to be gasified in a reactor is supplied through tube 13 at a rate of 10 to 1000 tons per day and includes an inert conveying gas such as nitrogen, carbon dioxide or a synthesis gas made in the process. The hydrocarbon is normally powdered coal, although oil could also be used. The coal particles are dispersed by impacting with each other and with the turbulence produced by the stream inside tube 12. The coal should be injected at a rate sufficient to produce the desired constituency of the synthetic gas in the reactor while the transpiration gas should have a flow rate of up to 20% by volume of oxygen flow to contain the oxygen jet until it strikes the combustion zone at a point well away from the burner.

From the foregoing description it can be seen that the position of the combustion zone in relation to the tip of the burner is such that the temperature of the burner is lower and the possibility of the reactants striking the burner is reduced. The heat load on the face of the burner is reduced substantially over that of burners presently used in gasification systems. It should be appreciated that the exact reduction of heat load on the burner will depend upon certain variables, namely, the rates of flow of the transpiration gas, oxygen, hydrocarbon and conveying gas. The important requirement of the present invention is that the transpiration gas be permitted to pass through conduit 14 and 15, and depending upon the porosity of this conduit, a lower flow rate of oxygen may be used than is required in present burners.

The foregoing description of the invention is merely intended to be explanatory thereof. Various changes in the details of the described burner may be made within the scope of the appended claims without departing from the spirit of the invention.

What is claimed is:

1. A process for burning hydrocarbon in a combustion zone, comprising:

introducing combustion oxygen and said hydrocarbon into a combustion chamber as a central gas flow;

surrounding said combustion oxygen with a transpiration gas; and passing at least some of the transpiration gas through a porous metal passage surrounding the combustion oxygen and having a non-constricted part of lower porosity metal next to the combustion zone, said porous metal comprising a compressed powdered metal.

2. The method of claim 1 wherein the hydrocarbon is introduced with conveying gas into the combustion oxygen.

3. The method of claim 1 wherein the transpiration gas is one or a mixture of water, nitrogen, carbon monoxide and hydrogen.

4. The method of claim 1 wherein the oxygen includes steam.

5. A burner for use in burning a hydrocarbon, comprising:

three essentially coaxial spaced-apart tubes;

a passage within the inner tube for conveying hydrocarbon and conveying gas to a combustion zone;

a passage between the inner tube and the intermediate tube for conveying oxygen to the combustion zone; and a passage between the intermediate tube and the outer tube comprised of porous metal for conveying a transpiration gas to the combustion zone and having a non-constricted part of lower porosity metal closest to the combustion zone.

6. The burner of claim 5 wherein the intermediate tube extends beyond the inner tube.

7. The burner of claim 5 wherein the porous metal comprises a compressed powdered metal.

8. The burner of claim 5 wherein the part of the porous metal passage closest to the combustion zone is of lower porosity than the remainder of the porous metal passage.

9. A burner for use in burning a hydrocarbon, comprising:

three essentially coaxial spaced-apart tubes;

a passage within the inner tube for conveying hydrocarbon and conveying gas to a combustion zone;

a passage between the inner tube and the intermediate tube for conveying oxygen to the combustion zone; and a passage between the intermediate tube and the outer tube comprised of porous metal for conveying a transpiration gas to the combustion zone, the intermediate tube having a portion of reduced diameter which extends beyond the inner tube and a porous metal of lower porosity than the remainder of the porous metal passage encircling said portion of reduced diameter.

* * * * *